US006460520B1

(12) United States Patent
Challis

(10) Patent No.: US 6,460,520 B1
(45) Date of Patent: Oct. 8, 2002

(54) EXHAUST GAS RECIRCULATION COOLER

(75) Inventor: Raymond Challis, South Wales (GB)

(73) Assignee: Senior Investments AG (CH)

( * ) Notice: Subject to any disclaimer, the term of this patent is extended or adjusted under 35 U.S.C. 154(b) by 0 days.

(21) Appl. No.: 09/696,408

(22) Filed: Oct. 25, 2000

(30) Foreign Application Priority Data

Oct. 26, 1999 (EP) ..... 99308479

(51) Int. Cl.[7] ..... F02M 25/07

(52) U.S. Cl. ..... 123/568.12; 123/41.01; 165/52; 60/617

(58) Field of Search ..... 123/568.12, 41.01; 165/51, 52, 172–184; 60/616–618

(56) References Cited

U.S. PATENT DOCUMENTS

| | | | | |
|---|---|---|---|---|
| 2,204,294 A | | 6/1940 | Blanchard | 257/246 |
| 2,549,093 A | | 4/1951 | Huber | 126/109 |
| 3,105,708 A | * | 10/1963 | Esty | 285/41 |
| 4,893,670 A | | 1/1990 | Joshi et al. | 165/40 |
| 5,482,089 A | * | 1/1996 | Weber et al. | 138/122 |
| 5,676,176 A | * | 10/1997 | Usui | 138/121 |
| 5,732,688 A | * | 3/1998 | Charlton et al. | 123/568.12 |
| 5,915,472 A | * | 6/1999 | Takikawa et al. | 165/158 |

FOREIGN PATENT DOCUMENTS

| | | | | |
|---|---|---|---|---|
| DE | 3132-641 | | 6/1982 | 7/10 |
| DE | 36 12 770 | | 4/1986 | |
| DE | 93 21 031 | | 1/1996 | 1/8 |
| DE | 297 08 011 | | 10/1998 | |
| EP | 0 298 369 | | 1/1989 | 1/8 |
| EP | 0 908 265 | | 4/1999 | 35/30 |
| EP | 0 930 429 | | 7/1999 | 25/7 |
| GB | 789068 | | 1/1958 | 64/3 |
| JP | 57-60192 | | 4/1982 | 7/14 |
| JP | 61-265430 | | 11/1986 | |
| JP | 63-61888 | | 3/1988 | 7/14 |
| JP | 4-73593 A | | 3/1992 | 7/10 |
| JP | 9-222287 | * | 8/1997 | |
| JP | 11-83352 | * | 3/1999 | |
| JP | 11-108578 | * | 4/1999 | |
| JP | 11-237192 | * | 8/1999 | |
| JP | 11237192 | | 8/1999 | 7/10 |
| JP | 11257166 | | 9/1999 | 25/7 |

* cited by examiner

*Primary Examiner*—Gene Mancene
*Assistant Examiner*—Arnold Castro
(74) *Attorney, Agent, or Firm*—Dick and Harris

(57) ABSTRACT

An exhaust gas re-circulation system provides for intake of exhaust gases from a first end 206 into one of a plurality of corrugated inner tubes 204 housed within an outer tube 200. Corrugations in said inner tube 204 provide for an increased surface area for heat exchange with a surrounding coolant medium and for decreased velocity of flow of exhaust gas increasing the density of charge of exhaust gas returned to a combustion chamber of an associated internal combustion engine by an inlet manifold where said exhaust gas re-circulation system connects to said inlet manifold at a second end 207. Said outer tube provides for inlet 203 and outlet 202 of coolant medium. Said outer tube further comprises corrugated portions to withstand vibration/expansion. Said inner and outer tubes are manufactured from thin wall metal tubes. Exhaust gas cooling occurs over the entire path length of the exhaust gas re-circulation system and is enhanced at bends 201 in the exhaust gas re-circulation system by formation of turbulent flow of the exhaust gas within said inner members 204 thus providing for increased heat exchange by occupying all of the available space within said corrugated inner members 204. No separate cooler unit is required and therefore the exhaust gas re-circulation system may be bent to be packaged around an internal combustion engine to provide for economy of space.

26 Claims, 3 Drawing Sheets

EXHAUST GAS RECIRCULATION COOLER

FIELD OF THE INVENTION

The present invention relates to components for internal combustion engines particularly, although not exclusively, to a tubular component for transferring exhaust gases between an exhaust manifold and an inlet manifold where exhaust gases are cooled during transfer between the exhaust manifold and the inlet manifold.

BACKGROUND TO THE INVENTION

It is known in the prior art to use exhaust gas re-circulation systems as part of an internal combustion engine. An exhaust gas re-circulation system transfers exhaust gas from an exhaust manifold, returning the exhaust gas to an inlet manifold on the engine block allowing the returned gas to re-enter a combustion chamber. The purpose of an exhaust gas re-circulation system is to reduce formation of NOX during the combustion process. A cooled exhaust gas re-circulation system achieves this by taking exhaust gas from an exhaust manifold, and cooling the gas during transfer between the exhaust manifold and an inlet manifold thus giving a dense charge of gas returned to the inlet manifold for introduction into an inlet charge prior to combustion.

Prior art exhaust gas re-circulation systems incorporate a multi-component system including a plurality of tubular elements including a cooling element. Commonly the cooling element is substantially straight and hence difficult to package around the internal combustion engine. FIG. 1 herein illustrates a prior art exhaust gas re-circulation system. This system incorporates a first tubular section 100 attached to an exhaust manifold by fastening means at a first end 107 and a second tubular section 111 attached to an inlet manifold at a second end 108. Referring to FIG. 1, exhaust gases entering tube 100 at first end 107, the direction of exhaust gas flow being indicated by arrows, are transferred to a cooler 102. This may occur through one or a plurality of bends 101 in tube 100 of the exhaust gas re-circulation system. Within the exhaust gas re-circulation system there exists a cooler section 102. This is a separate component joined to the first and second tubes 100, 111 at points 109 and 110. Cooler 102 consists of a heat exchanger housing a plurality of tubes 105 extending the length of cooler 102. The plurality of tubes 105 are illustrated in FIG. 1(B) which shows a section of cooler 102. Each tube 105 has a diameter in the region of 6 mm. The Cooler 102 may contain an average of 30 such tubes although in some instances this amount may be as great as 60. Cooler 102 further comprises an inlet 104 and outlet 103 which permit coolant medium to enter a chamber surrounding the plurality of smaller tubes 105, thus permitting heat exchange between the gasses passing through the tubes 105 and the surrounding coolant medium. Inlet 104 and outlet 103 are further connected to pipework and fittings of the internal combustion engine cooling system. Such a system commonly incorporates a radiator. Coolant medium within the cooler 102 is not permitted to enter the first or second tubes 100, 111, the coolant medium being restricted to the length of the cooler 102.

In prior art exhaust gas re-circulation systems employing a cooler 102 there is a significant loss of efficiency due to blocking of tubes 105 by sooty deposits, commonly being acidic deposits, which are formed in the tubes 105 due to condensation of partially or non-combusted fuel. Diesel fuel, includes sulphur based compounds which can form highly acidic compounds on partial combustion. Such deposits may therefore corrode and block the tubes 105. Such corrosion and blockage means that the performance of the cooler 102 deteriorates significantly over time. A considerable loss in efficiency is seen within the first five hours of operation of such a prior art exhaust gas re-circulation system with up to 20% reduction in efficiency occurring in this period due to coating and/or blockage of the tubes 105. Therefore, prior art exhaust gas re-circulation systems lose efficiency and begin to corrode on first use. Use of higher grade materials to counter corrosion is hampered by the cost of the solutions when applied to a prior art multi-tube design.

A further disadvantage of prior art exhaust gas re-circulation systems is that cooler 102 is commonly of the order of 100 mm to 300 mm in length. As the levels of required emissions from internal combustion engines, particularly those used in cars, decrease and as the need for employing such systems on small cars to ensure low levels of emissions increases manufacturers are commonly finding that there is not enough space to conveniently package prior art coolers which require significant room in which to fit the long, straight cooler 102.

SUMMARY OF THE INVENTION

One object of the present invention is to provide a single piece component for use as an exhaust gas re-circulation system for transferring exhaust gases from an exhaust manifold to an inlet manifold of an internal combustion engine, whilst cooling the exhaust gases during transfer.

A second object of the present invention is to provide an exhaust gas re-circulation system for an internal combustion engine including a self-cleaning mechanism to prevent blockage of tubes which are transferring exhaust gases.

A third object of the present invention is to provide an exhaust gas re-circulation system where heat exchanged between exhaust gases and a coolant medium, occurring indirectly through a tubular wall, can take place substantially along the entire length of said exhaust gas re-circulation system.

A fourth object of the present invention provides for an exhaust gas re-circulation system with a decreased number of tubular members required to provide for heat exchange with a surrounding coolant medium, whilst providing an effective surface area for heat exchange which provides for at least comparable cooling of exhaust gases when compared to prior art coolers.

A fifth object of the present invention is to provide a low weight, low cost exhaust gas re-circulation system for an internal combustion engine.

According to a first aspect of the present invention there is provided a component for transferring gases between an inlet port and an outlet port of an internal combustion engine said component characterized by comprising:

- a substantially tubular outer member having a first end and a second end, and an outer tubular wall extending between said first and second ends; and
- a plurality of substantially tubular inner members housed in said first substantially tubular outer member, wherein said second substantially tubular inner members are corrugated along at least part of their length.

Preferably said plurality of substantially tubular inner members extend substantially an entire length of said substantially tubular outer member between said first and said second ends.

Said plurality of substantially tubular inner members may comprise a plurality of tubular sections, each following a curved path.

Preferably said first substantially tubular outer member is corrugated throughout at least one portion.

Preferably said first substantially tubular outer member contains apertures suitable for inlet and outlet of a coolant medium.

Preferably said first and second ends of said outer tubular member are substantially blocked in order to retain coolant medium within said first substantially tubular outer member, save for apertures remaining to permit gas flow into each of said plurality of substantially tubular inner members.

Said plurality of substantially tubular inner members may be mounted through at least one spacer maintaining said substantially tubular inner members at substantially fixed position s relative to each other.

Said outer tubular member may be substantially bent to a required shape.

In one embodiment, said substantially tubular outer member is manufactured from metal tubing with a wall thickness in the region of 0.3 to 0.5 mm; and said substantially tubular inner members are manufactured from metal tubing with a wall thickness in the region of 0.2 to 0.3 mm.

Said first and second ends may comprise flanges with apertures for inserting fastening means to fasten said tub e to s aid engine, forming a gas-proof seal using a gasket.

The invention includes an internal combustion engine having an exhaust gas re-circulation system, said system including means for cooling and transferring gases wherein said means comprises:

a substantially tubular outer member having a first end and a second end;

a plurality of substantially tubular inner members housed in said first substantially tubular outer member;

wherein said substantially tubular inner members are corrugated along at least a part of their lengths.

Said first substantially tubular outer member preferably includes suitable apertures wherein a coolant medium can be circulated externally of said substantially tubular inner members, said coolant medium flowing in a circuit comprising:

said exhaust gas re-circulation system;

a radiator; and a pump, coolant storage vessel, pipework and fittings associated with said radiator, wherein said apertures connect said exhaust gas re-circulation system and said pipework to form a coolant circuit for passage of said coolant over said plurality of inner members.

Said first end of said substantially tubular outer member may be located at an exhaust manifold and said second end may be located at an inlet manifold wherein in operation of said engine coolant medium in said tube is restricted between said first and second ends and externally of said substantially tubular inner members, inlet and outlet of coolant medium from said tube occurring through inlet and outlet apertures.

Preferably said tube forms a single part for fitment to said engine, said tube being pre-bent to a specific configuration to provide economy of space when fitted to said engine.

In a preferred embodiment, said substantially tubular outer member has a metal wall thickness in the region of 0.3 mm to 0.5 mm.

Preferably, when fitted to an internal combustion engine, said first end of said substantially tubular outer member is fixed during operation at a vertically higher fixed point to said second end, both of said ends comprising flanges with apertures for inserting fastening means in order to fix said tube to said engine forming a gas-proof seal using a gasket.

According to a second aspect of the present invention there is provided a method of assembly of a tube for an internal combustion engine said method comprising the steps of:

locating a plurality of plates along the length of a plurality of corrugated substantially tubular inner members;

placing said combination of said plates and said plurality of substantially tubular inner members within a substantially tubular outer member; and fixing said plates in position.

Said method preferably further comprises the step of fastening said substantially tubular outer member to an internal combustion engine and radiator system.

According to third aspect of the present invention there is provided a method of cooling exhaust gases for an internal combustion engine exhaust gas re-circulation system said method comprising the steps of:

directing an exhaust gas flow into a plurality of corrugated substantially tubular members;

forming a turbulent flow of said exhaust gas within said corrugated substantially tubular members;

wherein heat exchange occurs through at least one substantially tubular wall of said plurality of corrugated substantially tubular members with a surrounding coolant medium.

In use, said gas flow may experience a decrease in velocity of gas flow within said plurality of corrugated members.

Whilst transferring said exhaust gases to an inlet manifold, small particulate matter may be driven through said plurality of corrugated substantially tubular members. The gases may form a turbulent flow within the corrugated tubular members.

During the passage of gases through the corrugated tubular member, heat is exchanged from said surrounding medium through a surrounding outer tubular wall to an external environment.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

Figure 1:
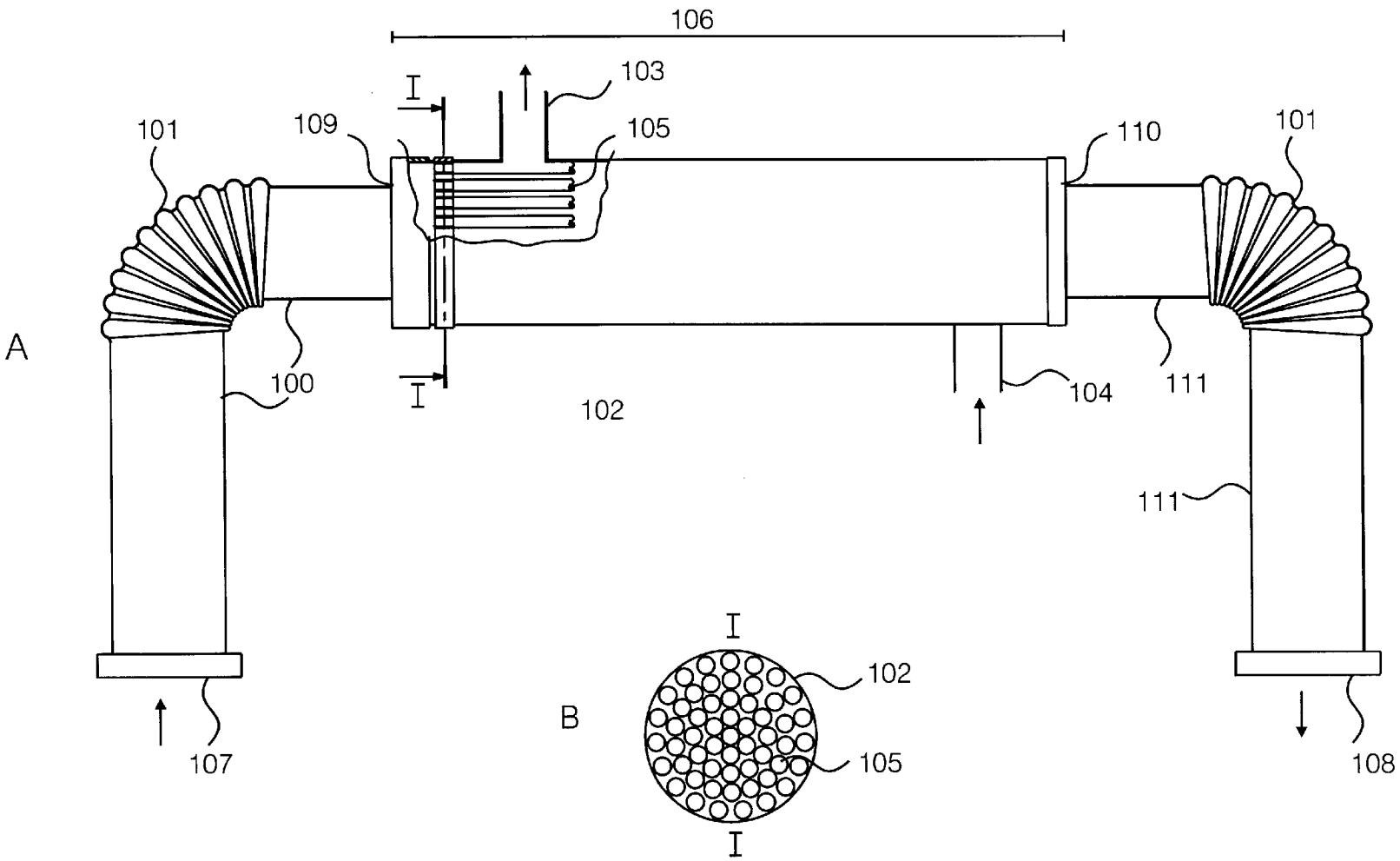
Fig. 1 (Prior Art)
FIG. 1(A) illustrates a prior art exhaust gas re-circulation system comprising a plurality of tubes 100, 111 connected to a cooler unit 102 through which exhaust gases are transferred from an internal combustion engine exhaust manifold into a first end 107 of the re-circulation system, and subsequently to an inlet manifold of said engine at a second end 108 of said exhaust gas re-circulation system.
FIG. 1(B) illustrates a cross-section along line I—I of the prior art cooler unit 102.
Figure 2:
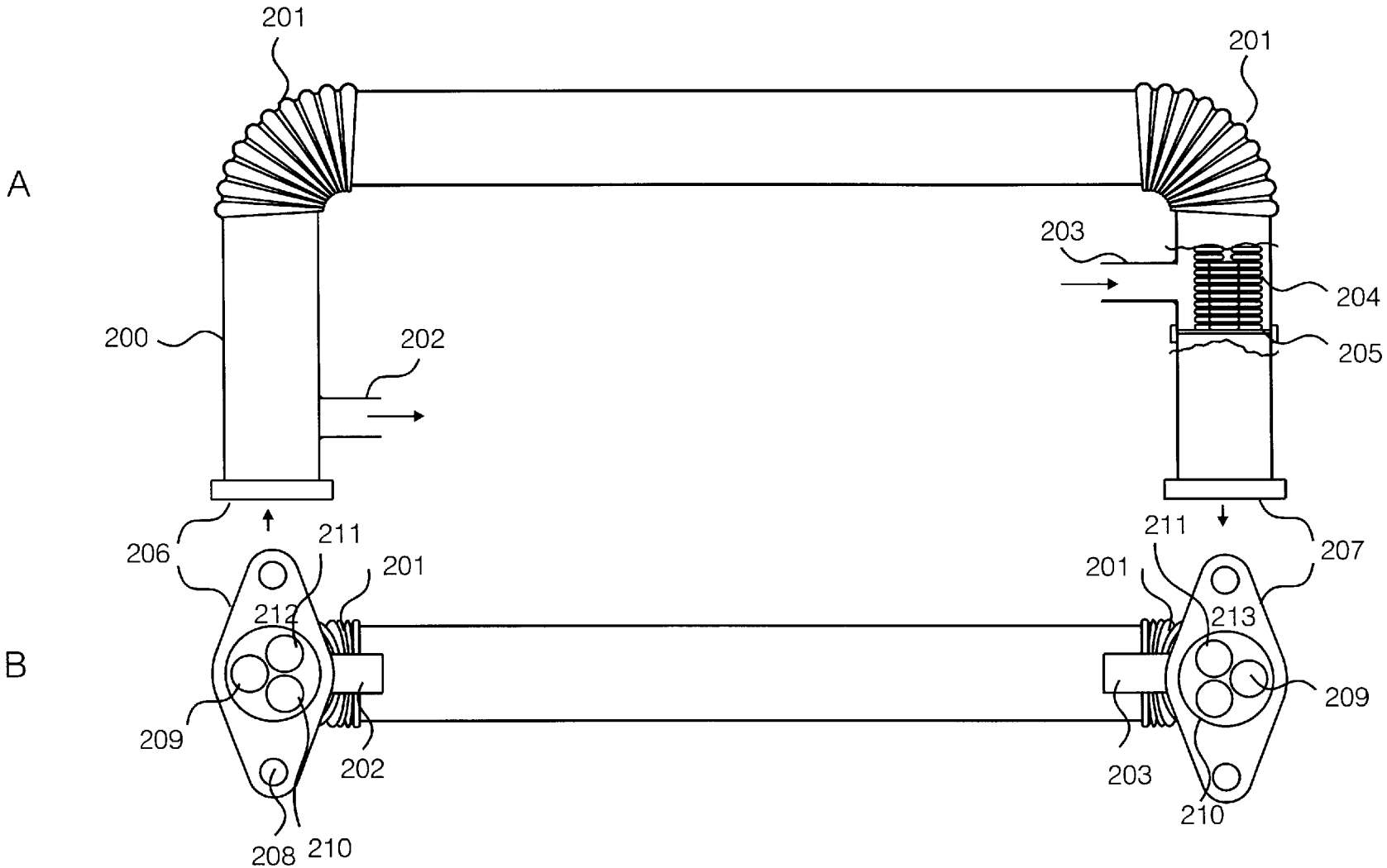
FIG. 2(A) illustrates an exhaust gas re-circulation system according to a specific embodiment of the present invention showing an external view of the overall system.
FIG. 2(B) illustrates the exhaust gas re-circulation system of FIG. 2(B) showing an external view looking at first and second flanges 206 and 207 for connecting to an exhaust manifold and inlet manifold respectively of an internal combustion engine.

FIG. 2 herein illustrates an exhaust gas re-circulation system component according to a first specific embodiment of the present invention. In this embodiment there is provided an exhaust gas re-circulation system for an internal combustion engine said internal combustion engine being configured for use in powering a motor vehicle. The invention however, is applicable to internal combustion engines used in many applications, e.g. in powering boats and planes. The exhaust gas re-circulation system comprises a first substantially tubular outer member 200 having a first end 206 and a second end 207, the outer member being made of stainless steel of an austenitic composition, and a plurality of tubular inner members 209, 210, 211 extending within the outer member 200 along its length between the first and second ends 206, 207 respectively, such that gases may enter the plurality of smaller inner tubular members at the first end 206 and exit the plurality of inner tubular members at the second end 207. Outer tubular member 200 comprises a tubular wall extends between first end 206 and second end 207 which may traverse one or a plurality of bends 201. At each bend there is provided a corrugated portion in the tubular wall. These corrugated portions provide for a change of direction of said first substantially tubular outer member, and further provide for absorption of engine vibrations, thermal expansion or other movements. The tubular wall of outer member 200 has a substantially circular tubular cross-section in the specific embodiment shown herein. However, it is to be understood that said tubular cross-section may be square or oval in shape. The precise shape of the tubular cross-section is not to be construed as limiting the invention.

In a typical automotive application, a diameter of the tubular outer member 200 may be of the order of 30 mm to 50 mm, and a diameter of each inner tubular member may be of the order of 6 mm to 15 mm, although the invention is not limited to these dimensions and a wider range of diameter dimensions are possible in different applications.

In the first specific embodiment of the present invention said first end 206 comprises a first flange portion 212 including a plurality of apertures 208 for insertion of screw fastening means. Said flange portion provides for location of said first end 206 to an exhaust manifold on the engine block of an internal combustion engine. Apertures 208 further provide for insertion of fastening means for example screw fastening means for attachment of said first end 206 to said exhaust manifold. At said second end 207 a similar second flange portion 213 exists, also with apertures for insertion of screw fastening means. This second flange portion at said second end allows for location of the re-circulation system component at an inlet manifold on the engine block of said internal combustion engine, said apertures allowing for insertion of fastening means for example screw fastening means to firmly attach said second end to said inlet manifold. Suitable gaskets may be used at both first and second ends to form a gas-proof seal in addition to the mechanically reliable seal formed by said flange portions and fastening means.

Said exhaust manifold provides for transfer of exhaust gases away from the engine block, hence in operation exhaust gases entering said exhaust gas re-circulation system comprise fully combusted, partially combusted and non-combusted vaporized fuel gases including any particulate matter and solid compounds produced during combustion. Hence said exhaust gases incorporate gas used as a relatively inert gas included in the burn mix to reduce cylinder temperature, and the presence of which reduces NOX emissions. Said exhaust gas re-circulation system provides a means of increasing the density of said exhaust gases by cooling and reducing the speed of flow of said exhaust gases before returning said exhaust gases to an inlet manifold and subsequently a combustion chamber of the engine. This provides for an increased quality of emissions from the internal combustion engine and therefore from the motor car, whilst also increasing the efficiency of the combustion process. The inlet manifold provides for transfer of vaporized fuel and re-circulated exhaust gases to the combustion chamber in the engine block.

In the first specific embodiment of the present invention the first substantially tubular outer member further comprises an inlet port 203 and an outlet port 202 for attachment of pipes or hoses connecting said exhaust gas re-circulation system to a suitable cooling system. Such a suitable cooling system typically includes a radiator, pipes and hoses, coolant medium pump, and a coolant medium storage vessel/reservoir. The inlet port 202 and outlet port 203 comprise cylindrical projections projecting perpendicularly from said first substantially tubular outer member, each of said inlet 202 and outlet 203 being an integral part of said first substantially tubular outer member. Thus, said outer member 200 is maintained as a single piece component. It should be understood however, that the incorporation of a separate inlet or separate outlet by for example a welded fixment is not limiting of the invention. The Inlet 203 and outlet 202 ports provide for attachment of hoses by commonly known prior art means of fixing. For instance said means of fixing may include a jubilee clip to fasten a rubber hose over either inlet port 203 or outlet port 202. Thus when in connection with a suitable cooling system, coolant medium may be pumped into said outer member at the inlet port 203, being removed from the exhaust gas re-circulation system through outlet port 202. The direction of coolant flow is indicated by arrows at inlet port 203 and outlet port 202 on FIG. 2(A). Coolant medium is restricted from leaving the exhaust gas re-circulation system at either said first end 206 or second end 207 by metal plates blocking any potential leak pathway.

In the first specific embodiment of the present invention and further referring to FIG. 2(A) and FIG. 2(B) herein, within said first substantially tubular outer member there is provided one or a plurality of second substantially tubular inner members, one or each of said inner members being corrugated. Said inner members 204 are illustrated in a cut-away section of FIG. 2(A). Said inner members are further illustrated at said flange portions at said first end and said second end. Here, said inner members are shown to have a hollow central portion providing for apertures 209 at said flange portions. Each of the inner members are preferably made of stainless steel of an austenitic composition.

In the first specific embodiment there are provided three of said second substantially tubular inner members within said first substantially tubular outer member. Each of said inner members extends the full length of the outer member 200 between said first end 206 and said second end 207. Said inner members may be maintained in position by a plurality of plate spacers within said outer as shown in this example. However, in the general case the metal spacers are not essential. One of said spacers 205 is illustrated in FIG. 2(A). Each of said spacers includes apertures to allow each of said inner members to pass through said spacers. Each of said spacers may be fixed at said tubular wall of said tubular outer member. The spacers maintain the inner members in a substantially constant position but do not significantly restrict the flow of coolant medium around the inner members.

Although in the first specific embodiment of the present invention each of said inner members is corrugated throughout its entire length between said first end 206 and second end 207 of said outer member it is understood that portions of said inner members may not be corrugated if this is necessary to facilitate the working of the invention.

Further referring to FIG. 2 herein, the first substantially tubular outer member is manufactured from metal tubing, for instance stainless steel metal tubing with a wall thickness in the region of 0.3 to 0.5 mm, and typically 0.4 mm. This may be compared to a prior art wall thickness of 0.7 mm to 1.0 mm. This provides for a better release of heat by heat exchange from coolant medium within said first substantially tubular outer member to the surrounding external environment outside the outer member, this being the air surrounding the internal combustion engine. The external environment thus includes the surrounding atmosphere. Corrugated portions existing at bends 201 in said outer member further provide for an increased surface area for heat exchange with the external environment.

Said inner members are manufactured from a corrugated metal tube, for instance corrugated stainless steel tube of an austenitic composition, with a wall thickness in the region 0.2 to 0.3 mm, typically 0.25 mm. This may be compared to a prior art wall thickness in the region of 0.4 mm to 1.0 mm. The thin walls of said inner members provide for improved thermal transfer and hence heat exchange with a surrounding coolant medium. Corrugations on said inner members provide for a large surface area for heat exchange with the surrounding coolant medium. Hence, heat exchange between exhaust gases within said inner members and the coolant medium in said outer member is optimized. The corrugations comprise shaping of the continuous tubular wall of a said inner member into an outer helical ridge portion having a first diameter, and an inner helical trough portion having a second diameter, wherein the first diameter is greater than the second diameter, the outer helical ridge running parallel with the inner helical trough, such that in a direction along a main central axis of the inner member, gas flowing through a central passage of the inner member experiences alternatively, the helical trough wall of the inner member, followed by an inner surface of the outer ridge portion of the wall followed by an inner surface of the trough portion of the wall, followed by an inner surface of the outer ridge portion of the wall and so on, along the length of the corrugated portion of the inner member.

In other embodiments, the corrugations may not form the wall of the inner member into a helical ridge, but may comprise a series of annular ridges and troughs alternating sequentially along a length of the inner member.

Said inner members are manufactured from a relatively thin metal tube. However, the strength of said inner members is not compromised as the corrugations of said inner members provide for strength. Thus the exhaust gas re-circulation system may be sufficiently robust to withstand the rigors of operation as part of an internal combustion engine in a motor vehicle.

As the exhaust gas re-circulation system comprises a single component, the tubular inner and outer members may be manufactured to a specific shape to package efficiently around an internal combustion engine. Many bends may be incorporated in the exhaust gas re-circulation system as no single straight section in which to incorporate a separate prior art cooler 102 is required. That is, cooling may occur over the entire path length of the exhaust gas re-circulation system, the path length being the distance between said first end 206 and second end 207. Further, the fact that the specific embodiments of the present invention provide for a single component for an internal combustion engine as an exhaust gas re-circulation system, means there is a reduced cost of manufacture and a reduction in the weight of the exhaust gas re-circulation system. This is largely due to the fact that heavy prior art cooler units eg cooler 102 are not required. Further, the lightweight nature of the system is facilitated by the use of thin walled tube and the use of corrugated tubes to provide an increased surface area for heat exchange without the need for long lengths of straight tube as is required in prior art coolers.

The coolant medium which is inlet to the interior of said outer member and thus the exterior surface of said inner members is substantially the same as a standard coolant medium used in an internal combustion cooling system eg a radiator system used with the internal combustion engine of a car. Thus, the coolant medium may be a mixture of water and specific additives to facilitate anti-corrosion, anti-freeze and efficient cooling, as will be known to those knowledgeable in the art.

In order to provide that a minimum efficiency of the exhaust gas re-circulation system of the present specific embodiment is at least as efficient as prior art exhaust gas re-circulation systems, the total cross-sectional area for both exhaust gas flow through the exhaust gas re-circulation system and coolant flow around the tubular members where heat exchange is occuring is designed to be maintained at a level which provides better cooling than an equivalent external length dimensioned prior art cooler. In the first specific embodiment this has been achieved by using three of said inner members each of approximately 15 mm in diameter, with said outer member having a diameter of typically 50 mm. Said inner members thus have a significantly larger diameter when compared to prior art cooler heat exchanging tubes eg prior art, heat exchanging tubes 105. Therefore, blockage of said inner members due to deposit of small particulate matter including sooty deposits is unlikely, and the functional operation of said inner members is maintained. It is to be understood that for some applications where the path length may be increased or decreased the number of said inner members may decrease or increase respectively. Further, the diameter of said outer member may decrease or increase respectively. The inner member and outer member tube diameters may also be required to vary depending on the specific application.

In operation of the first embodiment of the present invention, said first end 206 is fastened using screw fastening means placed through aperture 208 to connect a flange portion of first end 206 to an exhaust manifold. A gas proof seal may be obtained using an appropriate gasket between said flange portion and said exhaust manifold. Said second end 207 of said outer member is likewise fastened to an inlet manifold of said engine. Exhaust gases emitted from said engine during operation of said engine pass through said exhaust manifold and enter any one of three apertures 209 formed by said inner members 204. Thus exhaust gas comprising a mixture of combusted, non-combusted and partially combusted gas and fuel enters the exhaust gas re-circulation system. Direction of exhaust gas flow is indicated by arrows at first end 206 and second end 207 on FIG. 2(A). Exhaust gases entering said exhaust gas re-circulation system are at an high temperature in the region of 300 to 700° C. Further, exhaust gases entering said exhaust gas re-circulation system at said first end 206 have a high velocity. Velocity and amount of exhaust gas flow will depend on the rate of drive cycle of said engine at a particular time. As exhaust gases enter said inner tube 204 they are forced to slow down.

Figure 3:
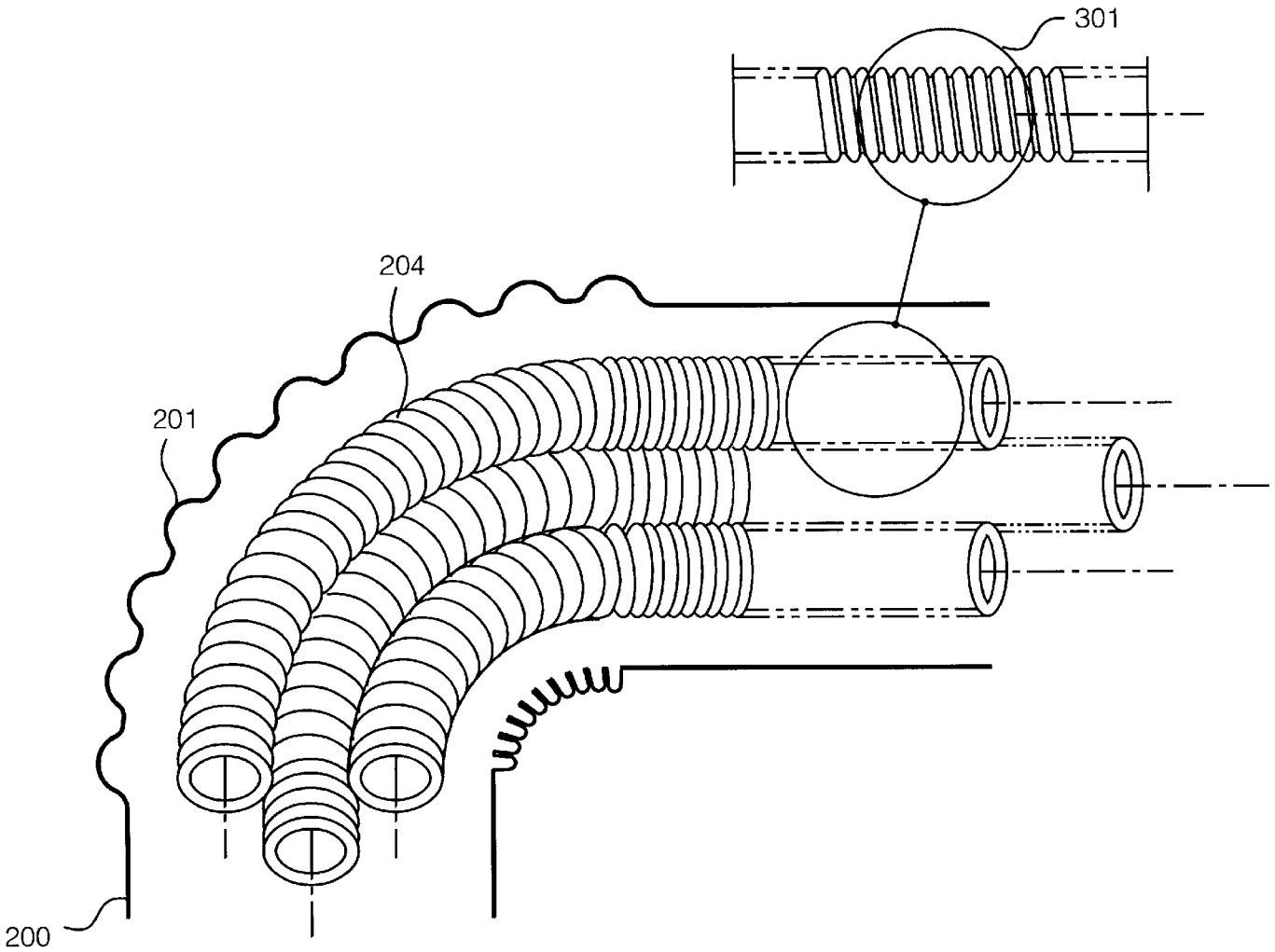
FIG. 3 illustrates a close up of a bend portion of the exhaust gas re-circulation system shown in FIG. 2.

Referring to FIG. 3 herein there is shown said inner members at a bend portion of said outer member 201 and there is further shown in a cut-away section a detailed section of the corrugations 301 of said inner members. The corrugations 301 provide a turbulent non-laminar flow path for said exhaust gases. Forcing said exhaust gases to adopt a turbulent flow path results in a decrease in velocity of the exhaust gases. Further, adopting the turbulent flow path ensures that hot exhaust gases having a decreased velocity compared to that on entry to the exhaust gas re-circulation system enter into efficient heat exchange with the surrounding coolant medium by contacting the extremities of troughs formed by corrugations of said inner members. The turbulent flow path further provides for a self-cleaning mechanism. To facilitate said self-cleaning mechanism, when incorporating said exhaust gas re-circulation system in an internal combustion engine said first end 206 is preferred to be installed at a higher vertical point than said second end 207. Hence said exhaust gas travels down a descending incline whilst being transferred through said exhaust gas re-circulation system. The combination of said incline and said turbulent flow path results in any sooty deposits including small particulate matter within the exhaust gas, or having been previously deposited, being driven through the exhaust gas re-circulation system. This overcomes the problem of prior art systems in which heat exchange tubes 105 became blocked with sooty deposits often being acidic in nature enhancing corrosion and causing blockage of the heat exchanging tubes. Hence, the exhaust gas re-circulation system of the present specific embodiment is self-maintaining.

Coolant medium is pumped into the exhaust gas re-circulation system through inlet 203 and surrounds said inner members over substantially the entire path length of said exhaust gas re-circulation system. Hence, heat exchange between exhaust gas and said inner members and subsequently between said inner members and said surrounding coolant medium is occuring over a majority of the whole path length of the exhaust gas re-circulation system component. At optimum configuration, the whole path length of said exhaust gas re-circulation system will be in operation for heat exchange. This provides a significant advantage over prior art coolers wherein the length of tubular members employed in cooling is less than an entire length of a prior art cooler. Thus, for a given length of exhaust gas re-circulation system the present invention provides for an increased cooling capability. Exhaust gas being returned to an inlet manifold at second end 207 is thus cooler and flowing at decreased speed compared to exhaust gas entering said exhaust gas re-circulation system at first end 206.

As coolant medium is pumped around the exhaust gas re-circulation system, typically at a rate of the order of 130 liters per hour, it will be pumped through outlet 202 and through associated hoses and pipes to said radiator via a cooling system. Here, said coolant medium may be cooled. However some cooling will occur between said coolant medium and the external environment by heat exchange between said coolant medium and the tubular wall of said outer member and between the tubular wall of said outer member and said external environment. Again, due to the fact that cooling is occuring over the entire path length of said exhaust gas re-circulation system then cooling between said outer member and the external environment is significantly greater than that provided between the tubular wall of prior art coolers eg cooler 102 and the external environment.

Further referring to FIG. 3 herein the first specific embodiment of the present invention provides for a plurality of bend portions 201, 204 in said outer and inner members wherein each bend portion includes corrugated portions. As exhaust gas passes through said inner members at bend portions such as that illustrated in FIG. 3, a turbulent flow of exhaust gas is set up within said inner members which aids the release of heat by slowing down said exhaust gas and enabling it to reach the extremities of the corrugations of said inner members providing for increased heat exchange efficiency. Thus, the fact that cooling occurs over the entire path length of said exhaust gas re-circulation system and the fact that said exhaust gas re-circulation system may include a plurality of bend portions without the need for a straight section to include a prior art type cooler means that the bend portions may actually provide an advantage to heat exchange and exhaust gas cooling, exhaust gas reduction in speed and increase in the density of charge of exhaust gases through the production of a turbulent flow of exhaust gas at said bend portions resulting in increased heat exchange.

The present embodiment therefore provides an improved means of cooling exhaust gases for re-combustion in an internal combustion engine via an exhaust gas re-circulation system. It is an inherent feature of transfer of exhaust gases through said exhaust gas re-circulation system that cooling of exhaust gases will occur. The use of corrugated tubes as inner members 205 results in a decreased speed of exhaust gas flow and increased surface area for heat exchange and thus cooling of exhaust gases via heat exchange with a surrounding coolant medium. The cooling of exhaust gases thus results in a denser charge of gas reaching said second end and thus the inlet manifold. This provides for complete combustion of re-circulated exhaust gases and therefore decreased emission. Corrugations provided by said inner members not only provide for an increased surface area but provide for a turbulent flow path which by varying the angle of pitch of the corrugations and also by varying the angle of incline of the exhaust gas re-circulation system may be enhanced to provide a means of self-cleaning and self-maintenance of the exhaust gas re-circulation system as sooty deposits or other small particulate matter and acidic material is driven through the system by exhaust gases entering the system. Thus the life span and efficiency of the exhaust gas re-circulation system is maintained. The exhaust gas re-circulation system can be fitted to an internal combustion engine as a single component making said system quickly and easily installable.

What is claimed is:

1. An exhaust gas re-circulation cooler comprising a component for transferring gases between an outlet port and an inlet port of an internal combustion engine said component comprising a substantially tubular outer member having a first end and a second end and an outer tubular wall extending between said first and second ends, said component further comprising at least one substantially tubular inner member housed in said first substantially tubular outer member, said component comprising:

said outer tubular wall having at least one corrugated portion; and at least one of said at least one substantially tubular inner member having helical corrugations throughout at least one portion of said at least one substantially tubular inner member enabling turbulent gas flow through said at least one substantially tubular inner member;

wherein both said substantially tubular outer member and at least one of said at least one substantially tubular inner member each have at least one bend portion; and said corrugated portion on said substantially tubular outer member providing flexibility of the exhaust gas re-circulation cooler to accommodate thermal expansion and engine vibration.

2. The exhaust gas re-circulation cooler according to claim 1, wherein said helical corrugations comprise the continuous tubular wall of said at least one substantially tubular inner member being formed into an outer helical ridge portion having a first diameter, and an inner helical trough portion having a second diameter, wherein the first diameter is greater than the second diameter, the outer helical ridge running parallel with the inner helical trough.

3. The exhaust gas re-circulation according to 1, wherein said helical corrugations are formed at said at least one bend portion to increase the turbulence of gas flow within said at least one substantially tubular inner member.

4. The exhaust gas re-circulation cooler according to claim 1, wherein said helical corrugations comprise the continuous tubular wall of said at least one substantially tubular inner member being formed into an outer helical ridge portion having a first diameter, and an inner helical trough portion having a second diameter, wherein the first diameter is greater than the second diameter, the outer helical ridge running parallel with the inner helical trough, and wherein said helical corrugations are formed at said at least one bend portion to increase the turbulence of gas flow within said at least one substantially tubular inner member.

5. The exhaust gas re-circulation cooler according to claim 1, wherein said helical corrugations comprise the continuous tubular wall of said at least one substantially tubular inner member being formed into an outer helical ridge portion having a first diameter, and an inner helical trough portion having a second diameter, wherein the first diameter is greater than the second diameter, the outer helical ridge running parallel with the inner helical trough, wherein said helical corrugations are formed at said at least one bend portion to increase the turbulence of gas flow within said at least one substantially tubular inner member, wherein said turbulent flow acts to drive sooty deposits through said at least one substantially tubular inner member by forming a helical flow as gas flowing through a central passage of the at least one substantially tubular inner member experiences alternatively, the helical trough wall of the at least one substantially tubular inner member, followed by an inner surface of the outer ridge portion of the wall.

6. The exhaust gas re-circulation cooler according to claim 1, wherein at least one substantially tubular inner member extends substantially an entire length of said substantially tubular outer member between said first and said second ends.

7. The exhaust gas re-circulation cooler according to claim 1, wherein said at least one substantially tubular inner member comprises a plurality of tubular sections, each following a curved path.

8. The exhaust gas re-circulation cooler according to claim 1, wherein said substantially tubular outer member contains apertures suitable for inlet and outlet of a coolant medium.

9. The exhaust gas re-circulation cooler according to claim 1, wherein said first and second ends of said substantially tubular outer member are substantially blocked in order to retain coolant medium within said substantially tubular outer member, save for apertures remaining to permit gas flow into said at least one substantially tubular inner member.

10. The exhaust gas re-circulation cooler according to claim 1, wherein said at least one substantially tubular inner member comprises at least two substantially tubular inner members mounted through at least one spacer maintaining said at least two substantially tubular inner members at substantially fixed positions relative to each other.

11. The exhaust gas re-circulation cooler according to claim 1, wherein:

said substantially tubular outer member is manufactured from metal tubing with a wall thickness in the region of 0.3 to 0.5 mm;

said at least one substantially tubular inner member is manufactured from metal tubing with a wall thickness in the region 0.2 to 0.3 mm.

12. The exhaust gas re-circulation cooler according to claim 1, wherein said substantially tubular outer member is substantially bent to a required shape.

13. The exhaust gas re-circulation cooler according to claim 1, for cooling exhaust gases in an internal combustion engine, having an exhaust gas re-circulation system.

14. An internal combustion engine having an exhaust gas re-circulation cooler comprising a component for transferring gases between an outlet port and an inlet port of an internal combustion engine said component comprising a substantially tubular outer member having a first end and a second end and an outer tubular wall extending between said first and second ends, said component further comprising at least one substantially tubular inner member housed in said first substantially tubular outer member, said component further comprising:

said outer tubular wall having at least one corrugated portion; and at least one of said at least one substantially tubular inner member having helical corrugations throughout at least one portion of said at least one substantially tubular inner member enabling turbulent gas flow through said at least one substantially tubular inner member;

wherein both said substantially tubular outer member and at least one of said at least one inner tubular member each have at least one bend portion; and said corrugated portion on said substantially tubular outer member providing for flexibility of the exhaust gas re-circulation cooler to accommodate thermal expansion and engine vibration.

15. The internal combustion engine according to claim 14, wherein said substantially tubular outer member includes suitable apertures into and out of which a coolant medium can be circulated externally of said at least one substantially inner tubular member, said coolant medium flowing in a circuit comprising:

said exhaust gas re-circulation cooler;

a radiator; and a pump, coolant storage vessel, pipework and fittings associated with said radiator, wherein said apertures connect said exhaust gas re-circulation cooler and said pipework to form a coolant circuit for passage of said coolant over said at least one substantially tubular inner member.

16. The internal combustion engine according to claim 14, wherein said first end of said substantially tubular outer member is located at an exhaust manifold and said second end is located at an inlet manifold wherein in operation of said engine, coolant medium in said substantially tubular outer member is restricted between said first and second ends and externally of said at least one substantially tubular inner member, inlet and outlet of coolant medium from said substantially tubular outer member occurring through inlet and outlet apertures.

17. The internal combustion engine according to claim 14, wherein said substantially tubular outer member includes suitable apertures into and out of which a coolant medium can be circulated externally of said at least one substantially tubular inner member, said coolant medium flowing in a circuit comprising:

said exhaust gas re-circulation cooler;

a radiator; and a pump, coolant storage vessel, pipework and fittings associated with said radiator, wherein said apertures connect said exhaust gas re-circulation cooler and said pipework to form a coolant circuit for passage of said coolant over said at least one substantially tubular inner member, wherein said first end of said substantially tubular outer member is located at an exhaust manifold and said second end is located at an inlet manifold wherein in operation of said engine, coolant medium in said outer member is restricted between said first and second ends and externally of said at least one substantially tubular inner member, inlet and outlet of coolant medium from said substantially tubular outer member occurring through inlet and outlet apertures.

18. The internal combustion engine according to claim 14, wherein said exhaust gas re-circulation cooler forms a single assembly for fitment to said engine, said cooler being pre-bent to a specific configuration to provide economy of space when fitted to said engine.

19. The internal combustion engine according to claim 14, wherein said substantially tubular outer member has a metal wall thickness in the region of 0.3 to 0.5 mm.

20. The internal combustion engine according to claim 14, wherein said first end of said substantially tubular outer member is fixed during operation at a higher fixed point to said second end.

21. A method of assembly of an exhaust gas re-circulation cooler, said exhaust gas re-circulation cooler comprising a component for transferring gases between an outlet port and an inlet port of an internal combustion engine said component comprising a substantially tubular outer member having a first end and a second end and an outer tubular wall extending between said first and second ends, said component further comprising at least one substantially tubular inner member housed in said first substantially tubular outer member, said component further comprising:

said outer tubular wall having at least one corrugated portion; and at least one of said at least one substantially tubular inner member having helical corrugations throughout at least one portion of at said least one substantially tubular inner member enabling turbulent gas flow through said at least one substantially tubular inner member;

wherein both said substantially tubular outer member and at least one of said at least one inner tubular member each have at least one bend portion; and said corrugated portion on said substantially tubular outer member provides for flexibility of the exhaust gas re-circulation cooler to accommodate thermal expansion and engine vibration, said method comprising the steps of:

locating a plurality of plates along the length of said helically corrugated at least one substantially tubular inner member;

placing the combination of said plates and said at least one substantially tubular inner member within a substantially tubular outer member; and fixing said plates in position.

22. The method according to claim 21, further comprising the step of fastening said substantially tubular outer member to an internal combustion engine and radiator system.

23. A method of cooling exhaust gases for an internal combustion engine exhaust gas re-circulation system comprising an exhaust gas re-circulation cooler, said exhaust gas re-circulation cooler comprising a component for transferring gases between an outlet port and an inlet port of an internal combustion engine said component comprising a substantially tubular outer member having a first end and a second end and an outer tubular wall extending between said first and second ends, said component further comprising at least one substantially tubular inner member housed in said first substantially tubular outer member, said component further comprising:

said outer tubular wall having at least one corrugated portion; and at least one of said at least one substantially tubular inner member having helical corrugations throughout at least one portion of said at least one inner member enabling turbulent gas flow through said at least one substantially tubular inner member;

wherein both said substantially tubular outer member and at least one of said at least one inner tubular member each have at least one bend portion; and said corrugated portion on said substantially tubular outer member provides for flexibility of the exhaust gas re-circulation cooler to accommodate thermal expansion and engine vibration, said method comprising the steps of:

directing an exhaust gas flow into said at least one substantially tubular inner member forming part of said exhaust gas re-circulation cooler;

forming a turbulent flow of said exhaust gas within said corrugated at least one substantially tubular inner member;

wherein heat exchange occurs through at least one substantially tubular wall of said at least one substantially tubular inner member with a surrounding coolant medium;

said exhaust gases being transferred through said at least one substantially tubular inner member to an inlet manifold.

24. The method according to claim 23, wherein said gas flow experiences a decrease in velocity of gas flow within said helically corrugated at least one substantially tubular inner member.

25. The method according to claim 23, wherein small particulate matter is driven through said at least one substantially tubular inner member.

26. The method according to claim 23, wherein heat is exchanged from said surrounding medium through a surrounding outer tubular wall to an external environment.

* * * * *